US006994347B2

(12) United States Patent
Tessel et al.

(10) Patent No.: US 6,994,347 B2
(45) Date of Patent: Feb. 7, 2006

(54) HIT SCORING APPARATUS FOR SHOOTING PRACTICE

(76) Inventors: Mordechai Tessel, 2 Barkan Street, Kfar-Saba (IL), 44288; Kira Tessel, 2 Barkan Street, Kfar-Saba (IL), 44288; Dina Rolel, 2 Barkan Street, Kfar-Saba (IL), 44288; Netanel Tessel, 2 Barkan Street, Kfar-Saba (IL), 44288

( * ) Notice: Subject to any disclaimer, the term of this patent is extended or adjusted under 35 U.S.C. 154(b) by 42 days.

(21) Appl. No.: 10/384,207

(22) Filed: Mar. 6, 2003

(65) Prior Publication Data

US 2003/0168812 A1 Sep. 11, 2003

(30) Foreign Application Priority Data

Mar. 7, 2002 (SE) ..... 148561

(51) Int. Cl.
*F41J 5/048* (2006.01)

(52) U.S. Cl. ..... 273/373; 273/407

(58) Field of Classification Search ..... 273/371–376, 273/406, 407

See application file for complete search history.

(56) References Cited

U.S. PATENT DOCUMENTS

| | | | | |
|---|---|---|---|---|
| 2,576,960 A | | 12/1951 | McAvoy | 273/102.2 |
| 2,693,959 A | * | 11/1954 | Ross, Jr. | 273/373 |
| 2,749,125 A | | 6/1956 | Ream | 273/102.2 |
| 3,004,735 A | | 10/1961 | Kinard | 244/14 |
| 3,004,763 A | | 10/1961 | Knapp | 273/102.2 |
| 3,112,110 A | * | 11/1963 | Schulman | 273/373 |
| 3,580,579 A | | 5/1971 | Scharz et al. | 273/102.2 A |
| 3,705,725 A | * | 12/1972 | Thalmann | 273/373 |
| 3,854,722 A | * | 12/1974 | Ohlund et al. | 273/373 |
| 4,706,963 A | * | 11/1987 | Geuss | 273/348.1 |
| 4,848,269 A | | 5/1989 | Tessel | 273/373 |
| 4,946,171 A | * | 8/1990 | Merle et al. | 273/348.1 |
| 5,934,678 A | * | 8/1999 | Theissen et al. | 273/386 |

* cited by examiner

*Primary Examiner*—Mark S. Graham
(74) *Attorney, Agent, or Firm*—Schneck & Schneck; Thomas Schneck

(57) ABSTRACT

The invention provides a hit-scoring apparatus for shooting practice, comprising a target holder consisting of a body constituting the first and second jaws of a clamping device, the first jaw and the second jaw being electrically insulated from one another, means adapted to produce a relative movement between the first jaw and the second jaw, and a target panel clampable between the first and second jaws, the target panel consisting of a plurality of layers including an electrically conductive front layer and an electrically conductive second layer separated and spaced apart from the front layer by at least one electrically non-conductive layer. When the target panel is clamped between the first and second jaws of the target holder, separate electrical contacts are established between the front layer and the first jaw on the one hand, and between the second layer and the second jaw on the other hand, the first and second jaws being further connectable to a hit-scoring unit.

8 Claims, 4 Drawing Sheets

HIT SCORING APPARATUS FOR SHOOTING PRACTICE

FIELD OF THE INVENTION

The present invention relates to a hit-scoring apparatus for shooting practice. It also relates to a hit-scoring target panel for shooting practice.

BACKGROUND OF THE INVENTION

While hit-scoring targets per se are known which operate on the principle of producing a short circuit between two conductive layers whenever a projectile traverses the target (U.S. Pat. Nos. 2,576,960; 2,749,125; 3,004,735; 3,004,763 and 3,580,579), none of these prior art disclosures teaches an apparatus including not only the target panel, but also a solid, ground-anchorable holder for the panel that also provides the terminals for the electrical connections to a remote counter unit.

DISCLOSURE OF THE INVENTION

It is thus one of the objects of the present invention to provide an apparatus for the rapid and secure mounting and dismounting of a target panel, as well as to provide a target panel easily and reliably positioned for use.

It is a further object of the invention to ensure that, once mounted, the two conductive surfaces of the panel are in intimate electrical contact with the holder terminals.

It is yet another object of the invention to provide an apparatus that permits differentiation between hits on at least two different, predetermined regions of a target panel.

According to the invention, the above objects are achieved by providing a hit-scoring apparatus for shooting practice, comprising a target holder consisting of a body constituting the first and second jaws of a clamping device, said first jaw and said second jaw being electrically insulated from one another; means adapted to produce a relative movement between said first jaw and said second jaw; a target panel clampable between said first and second jaws, said target panel consisting of a plurality of layers, including an electrically conductive front layer and an electrically conductive second layer separated and spaced apart from said front layer by at least one electrically non-conductive layer; wherein, when said target panel is clamped between said first and second jaws of said target holder, separate electrical contacts are established between said front layer and said first jaw on the one hand, and between said second layer and said second jaw on the other hand, said first and second jaws being further connectable to a hit-scoring unit, whereby, when a projectile penetrates said target panel, a transient electrical short is produced between said front and second layers of the panel, thereby actuating said hit-scoring unit and scoring a hit.

The above objects are further achieved by providing a hit-scoring target panel for shooting practice, comprising a plurality of layers including an electrically conductive front layer separated and spaced apart from said front layer by at least one electrically non-conductive layer, and at least one location aperture passing through said plurality of layers.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a top view of the apparatus according to the present invention, without the target panel;

FIG. 2 represents a view in the direction of arrow A in FIG. 1;

FIG. 3 is a cross-sectional view along plane III—III of FIG. 1;

FIG. 4 is a perspective view of the movable jaw;

FIG. 5 is a cross-sectional view of the target panel;

FIG. 6 shows the front face of the target panel;

FIG. 7 represents the rear face of the target panel;

FIG. 8 is a partial cross-sectional view illustrating the electrical connection of the panel rear face to the rear aluminum film;

Figure 9:
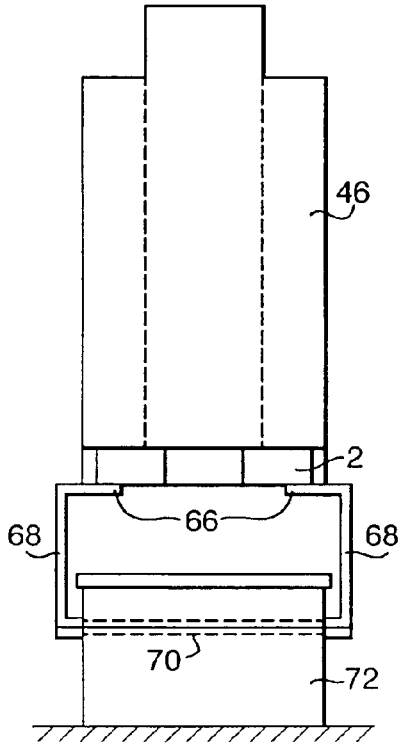
Figure 10:
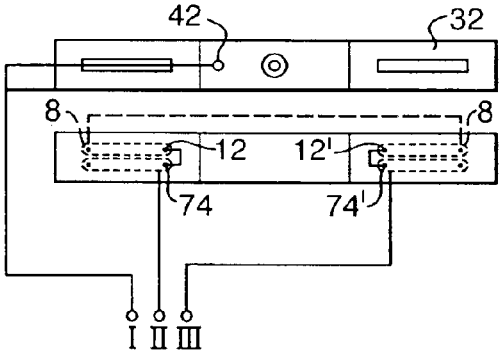
Figure 11:
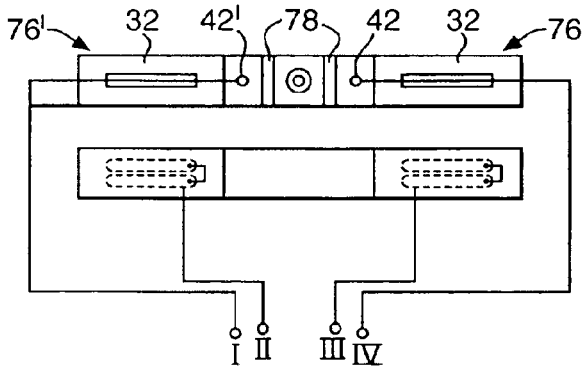

FIG. 9 schematically illustrates a swing-up base for mounting the target panel and device for shooting practice;

FIG. 10 is a wiring diagram of the clamping device according to the invention, and FIG. 11 is a wiring diagram of a different embodiment of the clamping device.

DETAILED DESCRIPTION

Figure 1:
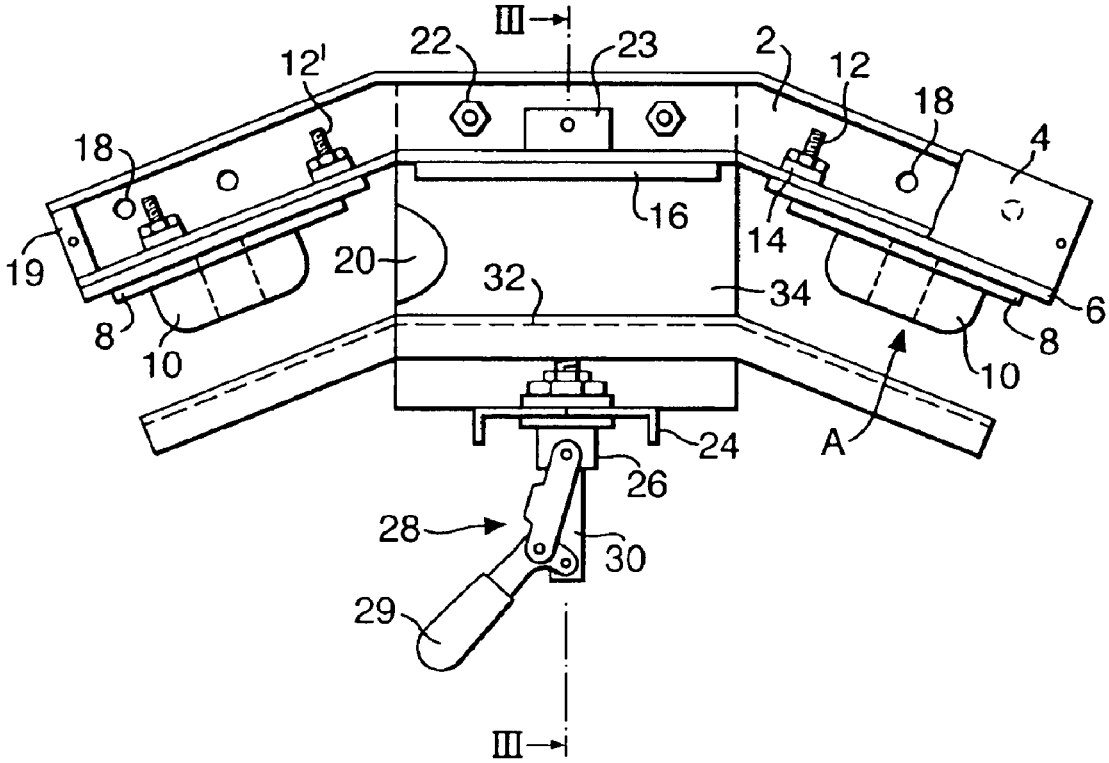
Figure 2:
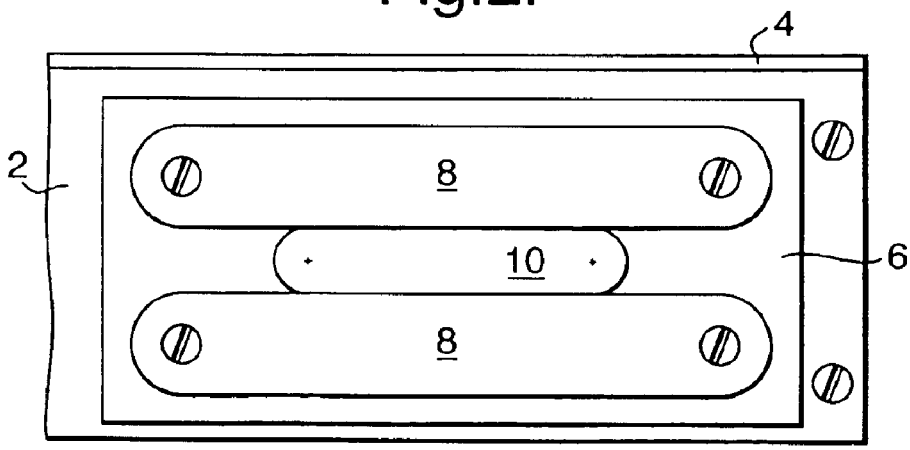

Referring now to the drawings, there is seen in FIG. 1 a metal body constituting the stationary jaw 2 of a clamping device, the profile of which is shown in FIG. 2. As seen, stationary jaw 2 consists of three sections: a central section and two lateral sections inclined with respect to the central section at an obtuse angle of about 160°. Jaw 2 is covered by a lid 4, part of which is seen on the right lateral section of jaw 2.

Attached to each of the lateral sections of jaw 2 are an electrically insulating plate 6 made, e.g., of an epoxy resin, as well as a pair of contact strips 8, seen to better effect in FIG. 2 and advantageously made of stainless steel. Between these strips 8, the purpose of which will be explained further below, there are disposed locator lugs 10, one each per lateral section, which fit windows provided in the target panels described further below and which serve to position these panels in the clamping device and maintain them in position. While plates 6 and lugs 10 are affixed to the vertical walls of jaw 2 with the aid of simple screws, contact strips 8, which must be electrically insulated from the mass of jaw 2, are attached by terminal posts 12 passing through the wall of jaw 2 via plastic bushings 14. Terminal posts 12 also serve as terminal posts for the wires leading to the remote counter unit.

The central section of jaw 2 is provided with an insulating plate 16, of a thickness approximately equaling the combined thicknesses of plate 6 and strips 8, but has no contact strips.

The two holes 18 in each of the lateral sections of jaw 2 serve for the connection of the clamping jaw to a base member such as that shown in FIG. 9. The jaw profile is closed at both ends by end plates 19.

Further seen in FIG. 1 is a bracket 20 (also see FIG. 3), to which jaw 2 is fixedly attached by means of screws 22. Bracket 20 also carries an upright 24, to which is fixedly attached toggle clamp body 26 of a per se known toggle clamp mechanism 28, shown in the position of maximum opening. When handle 29 of mechanism 28 is fully swiveled to the right, movable jaw 32 is pushed toward stationary jaw 2 until the target panel, described further below, is firmly clamped between jaws 2 and 32.

The movable jaw 32 of the clamping device is connected to plunger 30 (FIG. 3) of toggle clamp mechanism 28. Jaw 32, similar to jaw 2, consists of three sections: a central section and two lateral sections, the two lateral sections being inclined with respect to the central section at an angle identical with the analogue angle of the lateral stationary jaw sections.

Figure 3:
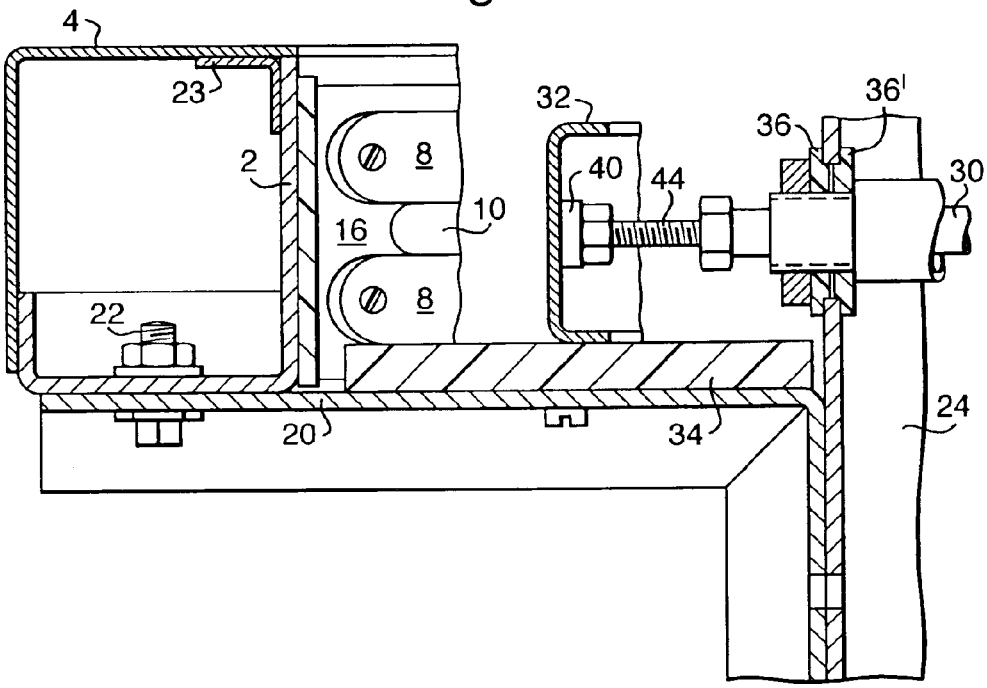

Making electrical contact with the second (rear) conductive surface of the target panel, movable jaw 32 must be electrically insulated from stationary jaw 2, which is in contact with the conductive front surface of the target panel. Insulation is ensured in two ways. As seen in FIG. 3, movable jaw 32 slides on and along a plastic plate 34 attached to bracket 20, and toggle clamp body 26 is mounted on upright 24 via two plastic washers 36, 36'.

Figure 4:
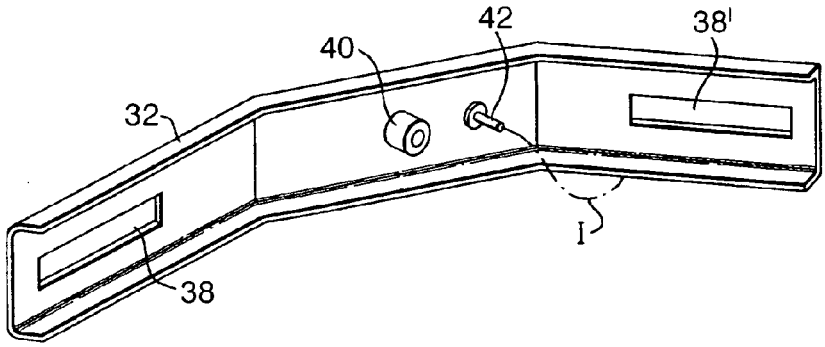

FIG. 4 is a rear view of the movable jaw 32. Jaw 32 is advantageously made of stainless steel sheet and has a shallow, U-shaped profile. Shown are two elongated, window-like openings which accommodate locator lugs 10 (FIG. 1) when movable jaw 32 closes in on stationary jaw 2. Also shown is a nut 40 welded to jaw 32, into which a threaded bolt 44 (FIG. 3) is lockable. Bolt 44 also fits plunger 30 of toggle clamp mechanism 28, and is used to set the final gap between stationary jaw 2 and movable jaw 32. A stud 42 welded to movable jaw 32 serves as a terminal post 42 for the rear face of the target panel when it is mounted in the clamping device.

The apparatus according to the invention permits distinguishing between hits at two different, pre-determined regions of the target panel.

Figure 5:
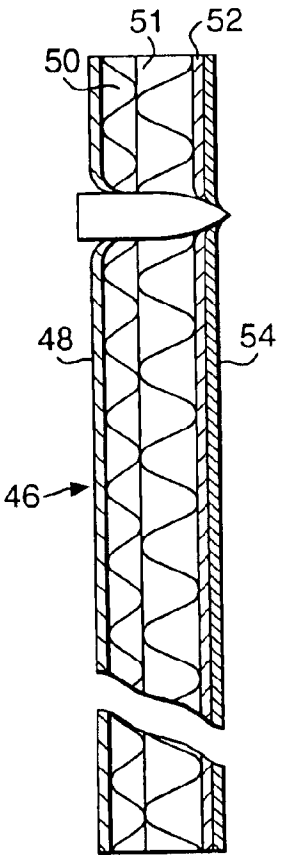

Target panel 46, of a per se known cross-section, is shown in FIG. 5 and comprises a front layer 48 consisting of a thin aluminum film, advantageously provided with an anodized or otherwise colored front surface of a dark hue which does not impair conductivity but rather reduces reflectivity and glare. Below layer 48 there is seen a standard, double-layer, corrugated cardboard layer 50, 51, to which is glued another aluminum film 52, this time without an anodized or colored surface. The outer rear surface of the panel is constituted by a layer of resin-impregnated paper 54 for reinforcement and waterproofing. A strip of a width of about 8 cm at the lower end is left unimpregnated, for a purpose which will become apparent further below.

Figure 6:
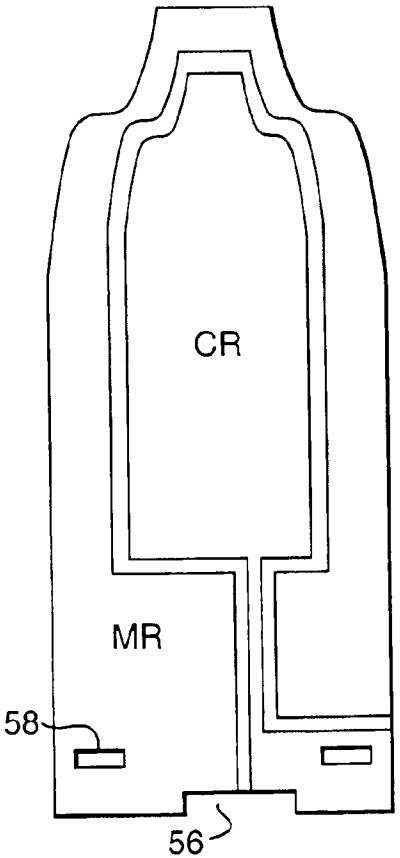

FIG. 6 illustrates a first step in the preparation of target panel 46, starting with the blank shown in FIG. 5. Shown is the front face of the target panel in which, after cutting the outer shape and recess 56 to accommodate bracket 20 and punching out locator windows 58 to accommodate lugs 10, two distinct hit regions have been defined and delineated: a central region CR and a marginal region MR. Separation of these regions is advantageously effected by using a double-bladed knife to cut through front layer 48, delineating the desired border between them. After that, the narrow strip of aluminum film remaining between the parallel cuts is peeled off, thereby electrically separating the two regions CR and MR. As can be seen in conjunction with FIG. 1, when target panel 46 is clamped into the clamping device, marginal region MR is in electrical contact with the pair of contact strips 8 on the right lateral section of stationary jaw 2, while central region CR is in electrical contact with the contact strips 8 on the left lateral section thereof.

Figure 7:
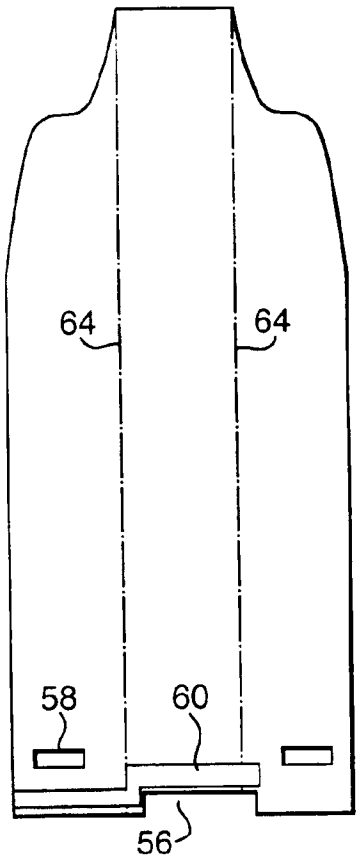

The rear face of target panel 46 is represented in FIG. 7. Here, there is no need for a separation of regions CR and MR, as aluminum film 52 (FIG. 5) is the common connector that closes the hit-scoring circuit whenever a projectile penetrates target panel 46, as shown in FIG. 5.

Figure 8:
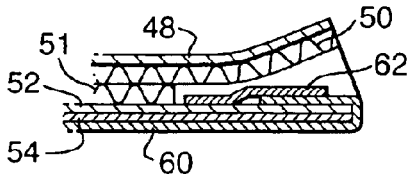

The rear face of panel 46 requires a different treatment: a strip of aluminum foil 60 is applied to the surface of paper layer 54, the left end of which strip is tucked in between cardboard layer 50 and aluminum film 52 and is brought into permanent, positive contact with film 52. The manner in which this is effected is illustrated in FIG. 8. A short, narrow section of corrugated cardboard layer 51, e.g., about 25 mm wide and 60 mm long, is removed, exposing aluminum film 52. The end of strip of foil 60 is then folded over and glued to film 52, using an electrically conductive adhesive. Then a short piece of copper foil 62 is glued to both the folded-over strip of foil 60 and aluminum film 52, ensuring good electrical contact. The gap in the corner of target panel 46 is then closed with the aid of a length of adhesive tape. Target panel 46 is then creased along crease lines 64, using a creasing die on a press, to impart to the panel a shape conforming to the shape of the gap between jaws 2 and 32, thus giving panel 46 great mechanical strength.

FIG. 9 illustrates one of the possible ways to mount the apparatus according to the invention on the ground. Applying screws and nuts, holes 18 in the stationary jaw 2 (FIG. 1) are used to mount the apparatus on platform 66 attached to arms 68, the lower ends of which are mounted on a shaft 70 that can be swiveled by means of an electric motor or an electric power solenoid (not shown), thereby turning target panel 46 into a pop-up or swing-up target. Base 72, which contains the swiveling mechanism, is heavy enough to ensure stability of the swing-up target panel 46.

FIG. 10 is a wiring diagram of the apparatus according to the invention. Schematically illustrated are stationary jaw 2 with its terminal posts 12, 12' and contact strips 8. Above stationary jaw 2 there is seen movable jaw 32 with its terminal post 42. Cable I is connected via terminal post 42 to the common aluminum film 52, while terminal post 12 connects cable II to marginal region MR and terminal post 12' connects cable III to central region CR. To ensure more positive contact, jumpers 74, 74' also connect the lower contact strips 8 to cables II, III. If, for some reason, the two-region feature is not desired, it can be eliminated by connecting contact strips 8 on both sides, as shown by the dashed-dotted lines indicating a wire connection. Obviously, provision may be made in a similar manner for more than two different hit-scoring regions.

If it is desired to provide two or more distinct hit-scoring regions on both sides of the target panel, or on several layers thereof, the wiring of the clamping device shown in FIG. 10 will have to be modified as shown in FIG. 11. In such a case, the movable jaws 32 are divided into two or more contacting regions 76, 76', separated by electrically insulating strips 78. Each of the jaws is provided with its own terminal posts 42, 42', leading via cables I and IV to the different layers of the target panel.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A hit-scoring apparatus for shooting practice, comprising:

a target holder having a body constituting a first stationary and a second movable jaw of a clamping device, said first jaw and said second jaw being electrically insulated from one another, wherein said stationary jaw has three integral sections, a central section and two lateral sections, said lateral sections including with said central section an obtuse angle;

means for imparting to said second jaw a substantially linear movement relative to said first jaw; and a target panel clampable between said first and second jaws, said target panel having a plurality of layers including an electrically conductive front layer and an electrically conductive second layer separated and spaced apart from said front layer by at least one electrically non-conductive layer, wherein when said target panel is clamped between the first and second jaws of said target holder, separate electrical contacts are established between said front layer and said first jaw on the one hand, and between said second layer and said second jaw on the other hand, said first and second jaws being further connectable to a hit-scoring unit.

2. The apparatus as claimed in claim 1, wherein said stationary jaw further comprises elongated lugs projecting from and fixedly attached to each of said lateral sections, said lugs registering with and engaging complementarily shaped, window-like openings in the lower part of said target panel.

3. The apparatus as claimed in claim 1, wherein said movable jaw includes window-like openings registering with and freely passing lugs in said stationary jaw.

4. The apparatus as claimed in claim 1, wherein said target panel is provided with two longitudinally extending creases, imparting to said target panel a cross-sectional shape substantially conforming to a gap between said stationary jaw and said movable jaw.

5. The apparatus as claimed in claim 1, wherein said means for producing said substantially linear movement is a self-locking toggle clamp mechanism.

6. A hit-scoring apparatus for shooting practice, comprising:

a target holder having a body constituting a first stationary and a second movable jaw of a clamping device, said first jaw and said second jaw being electrically insulated from one another, wherein said movable jaw has three integral sections, a central section and two lateral sections, said lateral sections including with said central section an obtuse angle substantially equal to the obtuse angle included by the lateral sections of said stationary jaw with the central section thereof;

means for imparting to said second jaw a substantially linear movement relative to said first jaw; and a target panel clampable between said first and second jaws, said target panel having a plurality of layers including an electrically conductive front layer and an electrically conductive second layer separated and spaced apart from said front layer by at least one electrically non-conductive layer, wherein when said target panel is clamped between the first and second jaws of said target holder, separate electrical contacts are established between said front layer and said first jaw on the one hand, and between said second layer and said second jaw on the other hand, said first and second jaws being further connectable to a hit-scoring unit.

7. A hit-scoring apparatus for shooting practice, comprising:

a target holder having a body constituting a first stationary jaw and a second movable jaw of a clamping device, said first jaw and said second jaw being electrically insulated from one another, said stationary jaw having three sections, a central section and two lateral sections, said lateral sections including with said central section an obtuse angle;

means adapted to produce a relative movement between said first jaw and said second jaw; and a target panel clampable between said first and second jaws, said target panel having a plurality of layers including an electrically conductive front layer and an electrically conductive second layer separated and spaced apart from said front layer by at least one electrically non-conductive layer, wherein when said target panel is clamped between the first and second jaws of said target holder, separate electrical contacts are established between said front layer and said first jaw on the one hand, and between said second layer and said second jaw on the other hand, said first and second jaws being further connectable to a hit-scoring unit.

8. A hit-scoring apparatus for shooting practice, comprising:

a target holder having a body constituting a first stationary jaw and a second movable jaw of a clamping device, said first jaw and said second jaw being electrically insulated from one another, said stationary jaw including three sections, a central section and two lateral sections, said lateral sections including with said central section an obtuse angle;

means adapted to produce a relative movement between said first jaw and said second jaw; and a target panel clampable between said first and second jaws, said target panel having a plurality of layers including an electrically conductive front layer and an electrically conductive second layer separated and spaced apart from said front layer by at least one electrically non-conductive layer, said target panel being provided with two longitudinally extending creases imparting to said target panel a cross-sectional shape substantially conforming to a gap formed between said stationary jaw and said movable jaw, wherein when said target panel is clamped between the first and second jaws of said target holder, separate electrical contacts are established between said front layer and said first jaw on the one hand, and between said second layer and said second jaw on the other hand, said first and second jaws being further connectable to a hit-scoring unit.

* * * * *